US011351598B2

(12) United States Patent
Moosman

(10) Patent No.: US 11,351,598 B2
(45) Date of Patent: Jun. 7, 2022

(54) METAL ADDITIVE MANUFACTURING BY SEQUENTIAL DEPOSITION AND MOLTEN STATE

(71) Applicant: Raytheon Company, Waltham, MA (US)

(72) Inventor: Bryan Robert Moosman, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 603 days.

(21) Appl. No.: 15/892,738

(22) Filed: Feb. 9, 2018

(65) Prior Publication Data

US 2018/0250737 A1 Sep. 6, 2018

Related U.S. Application Data

(60) Provisional application No. 62/467,134, filed on Mar. 5, 2017.

(51) Int. Cl.

| | |
|---|---|
| ***B22D 23/00*** | (2006.01) |
| ***B28B 1/00*** | (2006.01) |
| ***B28B 7/34*** | (2006.01) |

(52) U.S. Cl.

CPC ..... *B22D 23/003* (2013.01); *B28B 1/001* (2013.01); *B28B 7/346* (2013.01)

(58) Field of Classification Search

CPC ..... B22D 23/003; B28B 1/001; B28B 7/346
See application file for complete search history.

(56) References Cited

U.S. PATENT DOCUMENTS

| | | | | |
|---|---|---|---|---|
| 7,790,096 | B2 * | 9/2010 | Merot | B29B 13/021 264/497 |
| 9,228,859 | B2 * | 1/2016 | Ranky | G01L 1/142 |
| 10,099,267 | B2 * | 10/2018 | Stawovy | B22F 5/12 |
| 10,570,744 | B2 * | 2/2020 | Xu | C30B 11/003 |
| 10,641,045 | B2 * | 5/2020 | Cook, III | B22F 7/062 |
| 10,647,028 | B2 * | 5/2020 | McCarthy | B29C 33/40 |
| 10,946,447 | B2 * | 3/2021 | Hofmann | C22C 45/04 |

(Continued)

FOREIGN PATENT DOCUMENTS

| | | | | |
|---|---|---|---|---|
| WO | 2017/006098 | * | 1/2017 | B29C 67/00 |

*Primary Examiner* — Kevin R Kruer
(74) *Attorney, Agent, or Firm* — Renner, Otto, Boisselle & Sklar, LLP

(57) ABSTRACT

A three-dimensional (3D) printer includes a heated printing surface and a multi-tool extrusion assembly. The multi-tool extrusion assembly includes a barrier extrusion assembly and a metal extrusion assembly. The barrier extrusion assembly includes: a first inlet adapter to receive a barrier material; a first torque-and-pinch assembly, coupled to the first inlet adapter, to receive the barrier material; and a first hot-end assembly, coupled to the first torque-and-pinch assembly, to receive the barrier material and extrude the barrier material to form an outer retaining barrier on the heated printing surface. The metal extrusion assembly includes: a second inlet adapter to receive a metal; a second torque-and-pinch assembly, coupled to the second inlet adaptor, to receive the metal; and a second hot-end assembly, coupled to the second torque-and-pinch assembly, to extrude the metal to form an inner metal filing on the heated printed surface within the outer retaining barrier.

4 Claims, 14 Drawing Sheets

(56) References Cited

U.S. PATENT DOCUMENTS

2003/0141618 A1* 7/2003 Braithwaite ..... B29C 48/08 264/40.7
2006/0091199 A1* 5/2006 Loughran ..... G06Q 10/00 235/376
2007/0199822 A1* 8/2007 Bang ..... G01P 15/0802 205/67
2008/0173386 A1* 7/2008 Clark ..... B23K 35/3033 156/73.1
2013/0215197 A1* 8/2013 Hays ..... B41J 2/14 347/40
2013/0280547 A1* 10/2013 Brandl ..... B05D 3/06 428/565
2014/0339745 A1* 11/2014 Uram ..... C04B 35/19 264/681
2016/0023375 A1* 1/2016 Uram ..... C04B 35/18 264/133
2016/0067766 A1* 3/2016 Verreault ..... C22C 45/00 148/538
2016/0096326 A1* 4/2016 Naware ..... B29C 64/245 425/143
2016/0167156 A1* 6/2016 Burke ..... B33Y 50/02 219/74
2016/0237591 A1* 8/2016 Hanrath ..... C30B 25/10
2017/0008080 A1* 1/2017 Xu ..... B22F 3/24
2017/0182680 A1* 6/2017 England ..... B33Y 50/02
2017/0284208 A1* 10/2017 Xu ..... B33Y 80/00
2017/0297221 A1* 10/2017 Leu ..... B33Y 10/00
2017/0326623 A1* 11/2017 Wowczuk ..... B33Y 30/00
2018/0009128 A1* 1/2018 Sokol ..... B22C 9/24
2018/0056395 A1* 3/2018 Hofacker ..... B22F 3/115
2018/0071819 A1* 3/2018 Connor ..... B29C 64/393
2018/0253080 A1* 9/2018 Meess ..... G05B 19/4099
2018/0281115 A1* 10/2018 Seince ..... B23K 26/10
2018/0370080 A1* 12/2018 McCarthy ..... B29C 33/3842
2018/0370081 A1* 12/2018 McCarthy ..... B28B 7/346
2019/0054533 A1* 2/2019 Kenney ..... C22C 1/0416
2019/0091988 A1* 3/2019 Das ..... B29C 64/129
2019/0270135 A1* 9/2019 Kasperchik ..... B22F 1/0096
2019/0338382 A1* 11/2019 Fujiwara ..... B33Y 10/00
2019/0344387 A1* 11/2019 Tano ..... B33Y 50/02
2019/0366480 A1* 12/2019 Kotliar ..... B23K 26/03
2019/0375003 A1* 12/2019 Mark ..... B22D 31/002

* cited by examiner

METAL ADDITIVE MANUFACTURING BY SEQUENTIAL DEPOSITION AND MOLTEN STATE

RELATED APPLICATIONS

This application claims the benefit of U.S. Provisional Application No. 62/467,134, filed on Mar. 5, 2017, the entire content of which is hereby incorporated by reference.

TECHNICAL FIELD

The technical field is additive manufacturing technology primarily for metal and ceramic printing.

BACKGROUND

Additive manufacturing is a manufacturing method where an object is created by progressively adding material layer by layer until a desired form is achieved. This technology can be used in a wide range of applications—from creating plastic toys at home to manufacturing rocket thrusters for space engines.

The primary method used today to produce metal parts is known as Direct Metal Laser Sintering (DMLS). This technique uses a laser fired into a powdered metal gas stream to fuse the metal together. This process is repeated layer by layer until completion. An alternate form of this method (Selective Laser Sintering or SLS) typically uses a bed of powder and fully melts selected layers sequentially to produce the final object.

DMLS is typically expensive due to the complex lasers and vacuum chambers needed to create the parts. Due to the high accuracy of small layers (several micrometers), parts take a significant amount of time to create.

Other methods of metal printing including weld deposition and fused metal are currently under research, but no economically viable options have come to market. Technical challenges preventing low-cost metal printing include oxidation between layers and managing surface tension effects to maintain form.

BRIEF SUMMARY

The following is a simplified summary of the disclosure in order to provide a basic understanding of some aspects of the disclosure. This summary is not an extensive overview of the disclosure. It is intended to neither identify key or critical elements of the disclosure, nor delineate any scope of the particular implementations of the disclosure or any scope of the claims. Its sole purpose is to present some concepts of the disclosure in a simplified form as a prelude to the more detailed description that is presented later.

Aspects of the present disclosure use additive manufacturing to form metallic parts (e.g., additively manufactured part) by a new process of sequential deposition and heating. An outer barrier (molding) and an inner metal filling are dispensed consecutively to create an object. The barrier material is extruded first onto a heated print base (a platform) to form the outer barrier, after which the metal filling, typically in the molten state, is also extruded onto the platform within the outer barrier. The heated print base may maintain the metal filling contained within the cavity formed by the outer barrier in the molten state (e.g., through contact with a heated print base, by proximity to the heated print base). Both materials are added layer by layer to completion. Once cooled, the outer barrier is removed to expose the finished object.

BRIEF DESCRIPTION OF THE DRAWINGS

The figures shown illustrate several embodiments of the present disclosure and are not limiting in nature, or all-encompassing.

DETAILED DESCRIPTION

Figure 1:
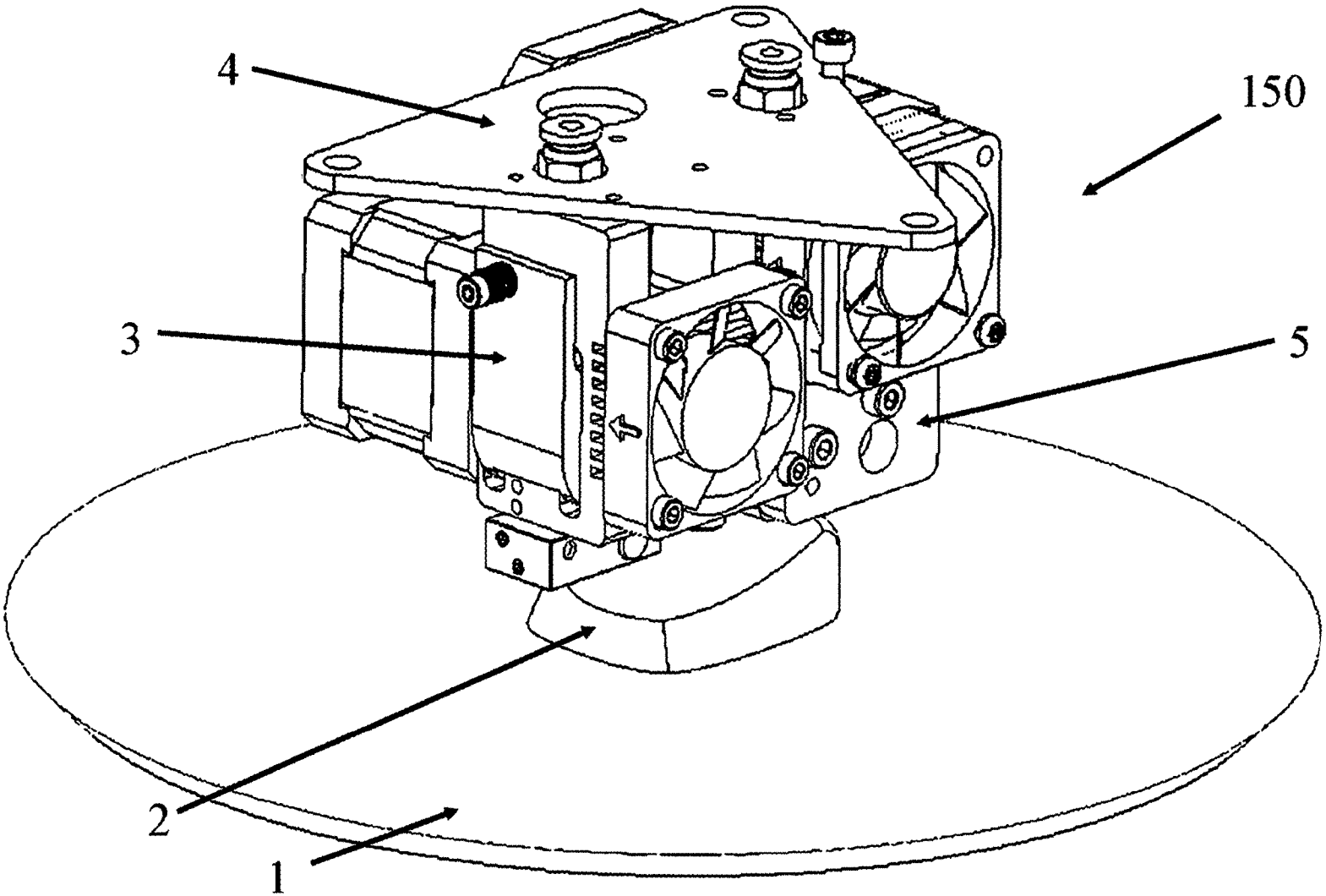
FIG. 1 illustrates a perspective view of a multi-tool extrusion assembly, according to one embodiment.

The description and terms used herein to describe the creation of metal parts are not intended to limit its use or application in the field. "Sequential deposition" is used to refer to the process of barrier material and metal deposition and does not imply any specific sequence unless directly stated. The term "barrier material" includes any material that has suitable properties to function as discussed. While the present disclosure has been described herein with respect to certain illustrated embodiments, those of ordinary skill in the art will recognize and appreciate that it is not so limited. Rather, many additions, deletions, and modifications to the illustrated embodiments may be made without departing from the scope of the present disclosure. Additionally, features from one embodiment may be combined with features from another embodiment while still being encompassed within the scope of the present disclosure. The methods disclosed should apply to any manifestation and not be limited by the specific implementations or examples given.

The present disclosure uses additive manufacturing (three-dimensional (3D) printing) to form metallic parts by simultaneous deposition and heating. An outer barrier (molding) and an inner metal filling are dispensed sequentially to create an object. The barrier material is extruded first onto the base print plate, after which the metal filling, in either a molten or a powder state, is also extruded onto the print surface. The metal is contained inside the cavity formed by the barrier material.

Once deposited, a print surface heats both the metal and barrier material to a suitable temperature to maintain the metal in liquid state and cure the barrier material. If the metal is extruded in the molten state, it remains in a liquefied condition, whereas if the metal is deposited as a powder or solid, the heated print surface causes the powder or solid to become molten (e.g., responsive to contact with the heated print surface, responsive to being proximate to the heated print surface, responsive to contact with a previously melted material).

The fluid nature of the melted metal allows the melted metal to flow into the crevasses of the outer barrier and fill the form created by the outer barrier. In one embodiment, the object is formed by layer-by-layer deposition of both barrier and metal. In another embodiment, the object is formed by layer-by-layer completion of the barrier followed by filling the created cavity with deposited metal.

When the object is completed, the object cools and solidifies. The outer barrier is removed, and the remaining object is the completed part.

This additive manufacturing method relies on the retaining of an outer barrier to preserve the form of the deposited metal while the deposited metal is in a molten state for the duration of the print. The additive manufacturing method includes: 1) Choice of a Barrier Material, 2) Deposition or Extrusion of the Barrier Material, 3) Identification of a Filling Metal, 4) Deposition or Extrusion of the Metal, 5) Heating the Print Surface 6) Maintaining or Transitioning the Metal to the Molten State, 7) Sequential Deposition of Metal and Barrier Material, and 8) Cooling and Removal of the Produced Part.

FIG. 1 illustrates a perspective view of multi-tool extrusion assembly 150, according to one embodiment. The multi-tool extrusion assembly 150 may deposit a printed object 2 over a print surface 1 (e.g., a build surface). The multi-tool extrusion assembly 150 may include a barrier extrusion assembly 3 and a metal extrusion assembly 5. An adapter plate 4 may be used to mount the multi-tool assembly 150 to a multi-axis movement system (not shown) to accomplish the deposition.

Figure 2:
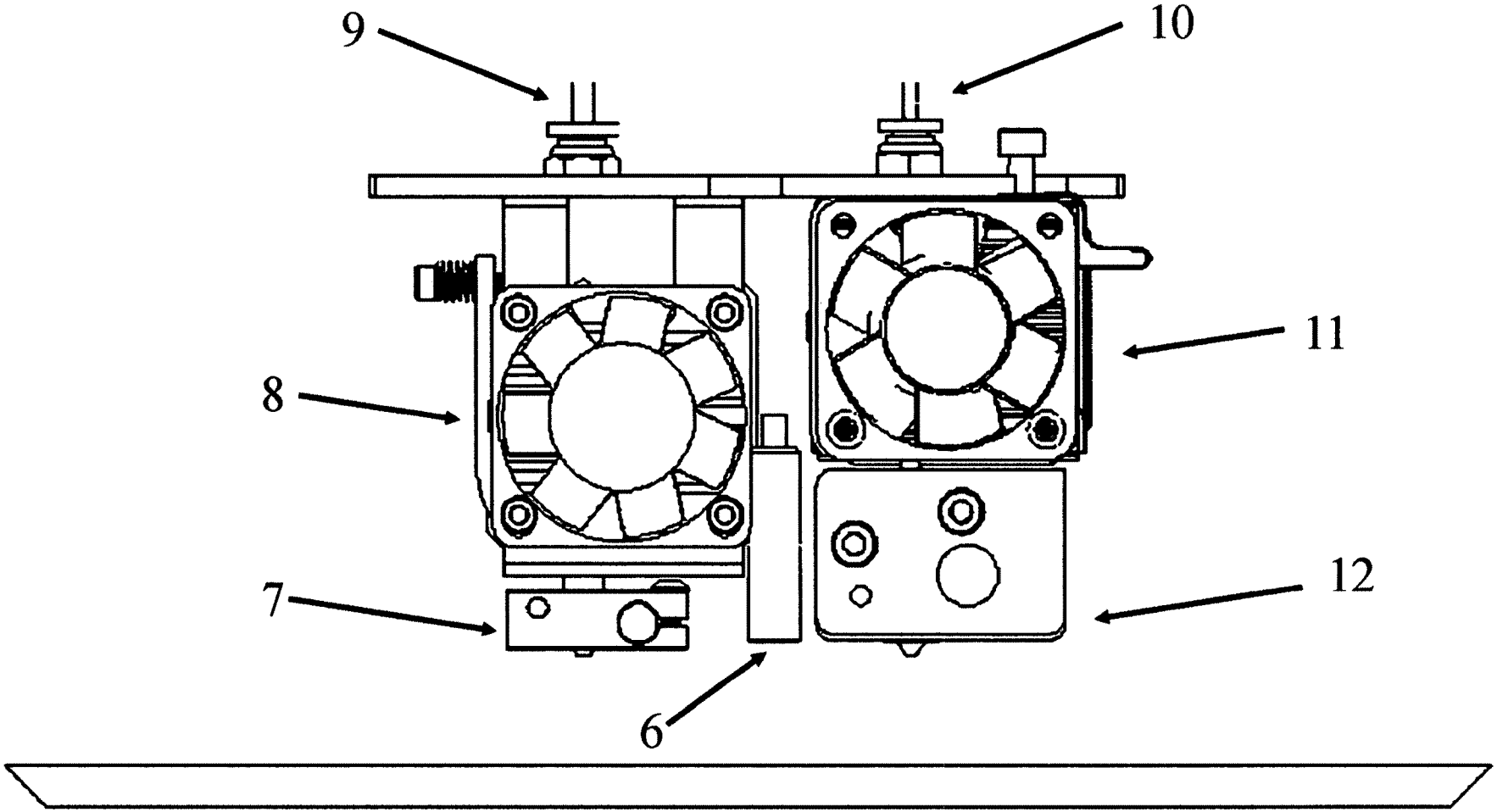
FIG. 2 illustrates a front view of the multi-tool extrusion assembly, according to one embodiment.

FIG. 2 illustrates a front view of the multi-tool extrusion assembly 150, according to one embodiment. The barrier material enters through a first inlet adapter 9, travelling through a first torque-and-pinch assembly 8 and into the barrier material hot-end assembly 7. The first torque-and-pinch assembly 8 and the barrier material hot-end assembly 7 may be part of the barrier extrusion assembly 3 of FIG. 1. The metal enters through a second inlet adapter 10, travelling through a second torque-and-pinch assembly 11 and into the metal hot-end assembly 12. The second torque-and-pinch assembly 11 and the barrier metal hot-end assembly 12 may be part of the metal extrusion assembly 5 of FIG. 1. A proximity sensor 6 may be used for machine calibration.

Figure 3:
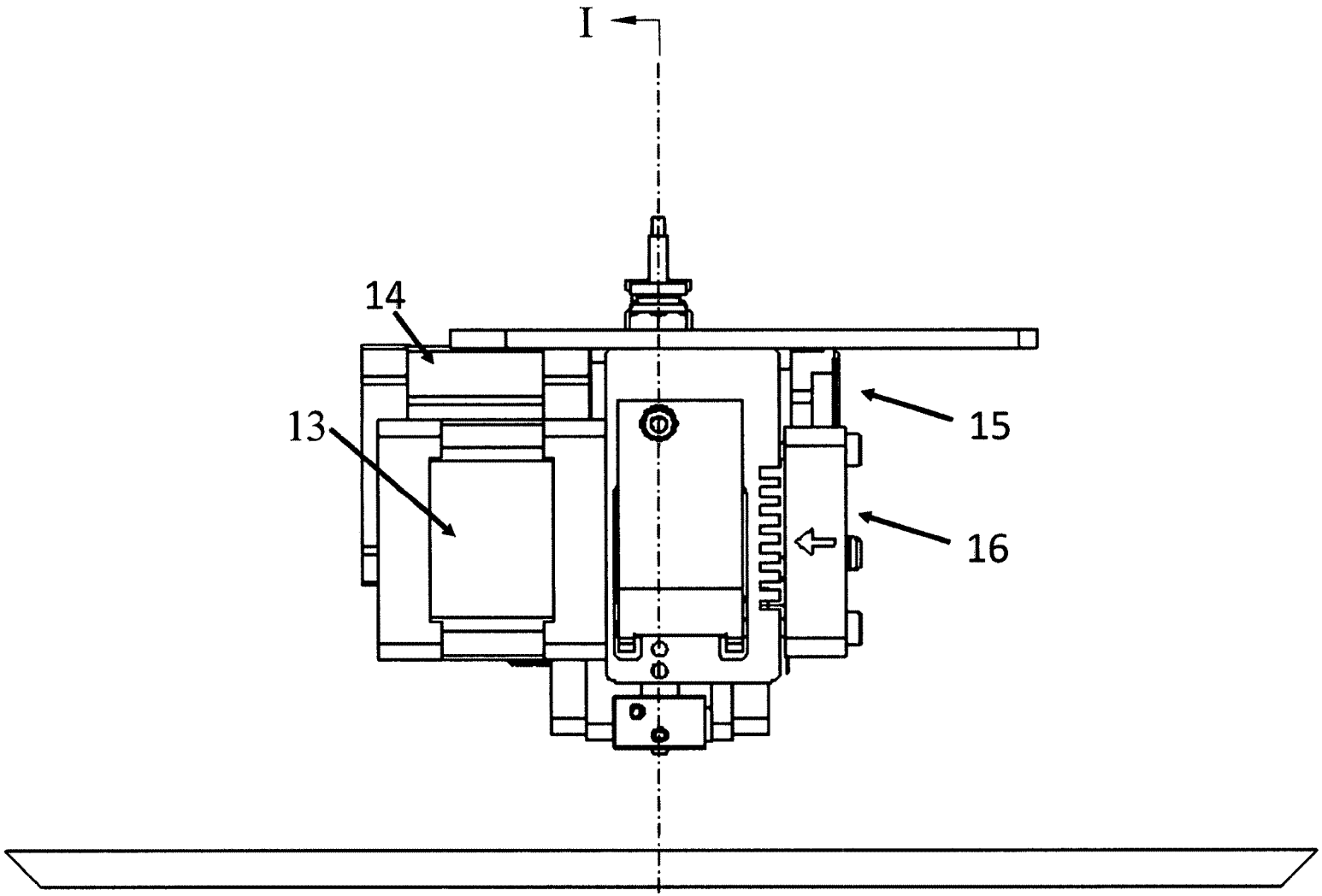
FIG. 3 illustrates a side view of the multi-tool extrusion assembly, according to one embodiment.

FIG. 3 illustrates a side view of the multi-tool extrusion assembly 150, according to one embodiment. Referring to FIG. 3, the cross section I is identified for use in FIGS. 4 through 14. In figures that contain alternate embodiments without isometric views, the assembly cross-section is taken as if the components shown were replaced with their alternate embodiments. FIG. 3 illustrates the barrier extrusion motor 13, the metal extrusion motor 14, and the metal and barrier cooling fans 15 and 16. The barrier extrusion motor 13 and the barrier cooling fan 16 may be part of the barrier extrusion assembly 3. The metal extrusion motor 14 and the metal cooling fan 15 may be part of the barrier extrusion assembly 3.

Choice of a Barrier Material

The barrier material may allow creation of a successful print. The barrier material is to 1) withstand the elevated temperatures of the liquid metal, and 2) maintain structural integrity and form throughout the manufacturing process. The barrier material is in direct contact with the molten metal. If the barrier material fails at any time, the entire print may be lost. If the barrier material hardens correctly after deposition, the barrier material may contain the liquid metal and result in a successful print.

Plastic materials used in 3D printers burn and melt at molten-metal temperatures. A suitable high temperature material will harden after deposition and maintain the desired shape to the completion of the part. The final print accuracy is determined by the precision of the deposition and the dimensional stability of the barrier material as it cures.

The barrier material is to adhere to itself as subsequent layers are produced. If the layers do not adhere, the layers may allow the molted metal to seep through, resulting in an unsuccessful print. When a water-based barrier material is deposited over a hot surface, the water in the immediate vicinity of the contact evaporates almost instantly, forming a gaseous barrier between layers that reduces or eliminates adhesion.

Barrier materials that are not water-based can produce toxic gasses as portions of the barrier material burn off. This is common for most binder-based materials such as plastics and resins. A properly designed print enclosure can safely remove these gases from the print chamber through a process known as positive-pressure airflow. Fresh air enters the unit from outside, pushing the fumes through a designated opening or duct for proper disposal.

In one embodiment, the multi-tool extrusion assembly 150 may use a barrier material that includes a high-temperature plastic-ceramic composite. Plastics undergo thermal degradation at elevated temperatures, which results in the plastic becoming brittle and discolored. This is desirable as a barrier material because it becomes stiff and can hold shape when in contact with liquid metal. Additives in the plastic, such as a powdered ceramic, can maintain form once the plastic has completely burned off. When using high-temperature plastic-ceramic composite materials, toxic fumes may be produced when the plastic burns off and may be properly disposed of. The remaining material can be used at higher temperatures for a variety of metals, including, but not limited to metals or combinations of metals; such as those found in group 4 (such as titanium), group 5 (such as vanadium), group 6 (such as chromium), group 7 (such as manganese), group 8 (such as iron), group 9 (such as cobalt), group 10 (such as nickel), group 11 (such as copper), group 12 (such as zinc), group 13 (such as aluminum), group 14 (such as tin) and group 15 (such as lead) of the periodic table.

In another embodiment, the multi-tool extrusion assembly may use a barrier material that includes a ceramic material (e.g., a pure ceramic material, a semi-liquid ceramic porcelain, a ceramic and a polymer, etc.). Ceramic materials are good thermal insulators and maintain structural integrity at elevated temperatures well beyond that required to melt most metals. When heated by a print surface, the ceramic material will cure, rendering the cured ceramic material resistive to the molten state of the metal. If a high degree of accuracy is required, a laser can be used to instantly cure the ceramic material or ceramic powder in a controlled manner.

Ceramic materials generally suffer from the gaseous barrier layer adhesion problems mentioned previously. The thermal shock between hot and cold materials can often cause layers to crack. A traditional ceramic body will also dry as the ceramic body is heated and will no longer adhere to new layers. These difficulties can be overcome by using a fiber material within the ceramic to promote bonding between layers.

In another embodiment, the multi-tool extrusion assembly may use a barrier material that includes a fiber material within a ceramic material. Fiber strands within a ceramic material transfer moisture from the newly deposited wet body to the dry body via embedded fibers. This allows the interface between the wet and dry materials to solidify as a joined body, greatly increasing the adhesion between the layers. The fibers act as a support structure during the thermal shock, reducing cracking as a new layer is deposited. Heat is also conducted through the wet fibers, decreasing the thermal gradient. The resulting combination enables the ceramic material to be deposited under higher temperatures with greater strength during the build process. Fiber additives are traditionally used in manual ceramic pottery repair, but have not been applied to the field of additive manufacturing.

Deposition or Extrusion of the Barrier Material

Extrusion of the barrier material may be achieved within several distinct embodiments or representations. In one embodiment, the extrusion of the barrier material is produced by solid filament pressure where a motor forces the solid filament into a melt chamber and exits in a malleable state through the printing nozzle. This technique, commonly used for plastic printing, may be modified to accommodate barrier material filaments which are typically more viscous than their traditional plastic counterparts.

Figure 4:
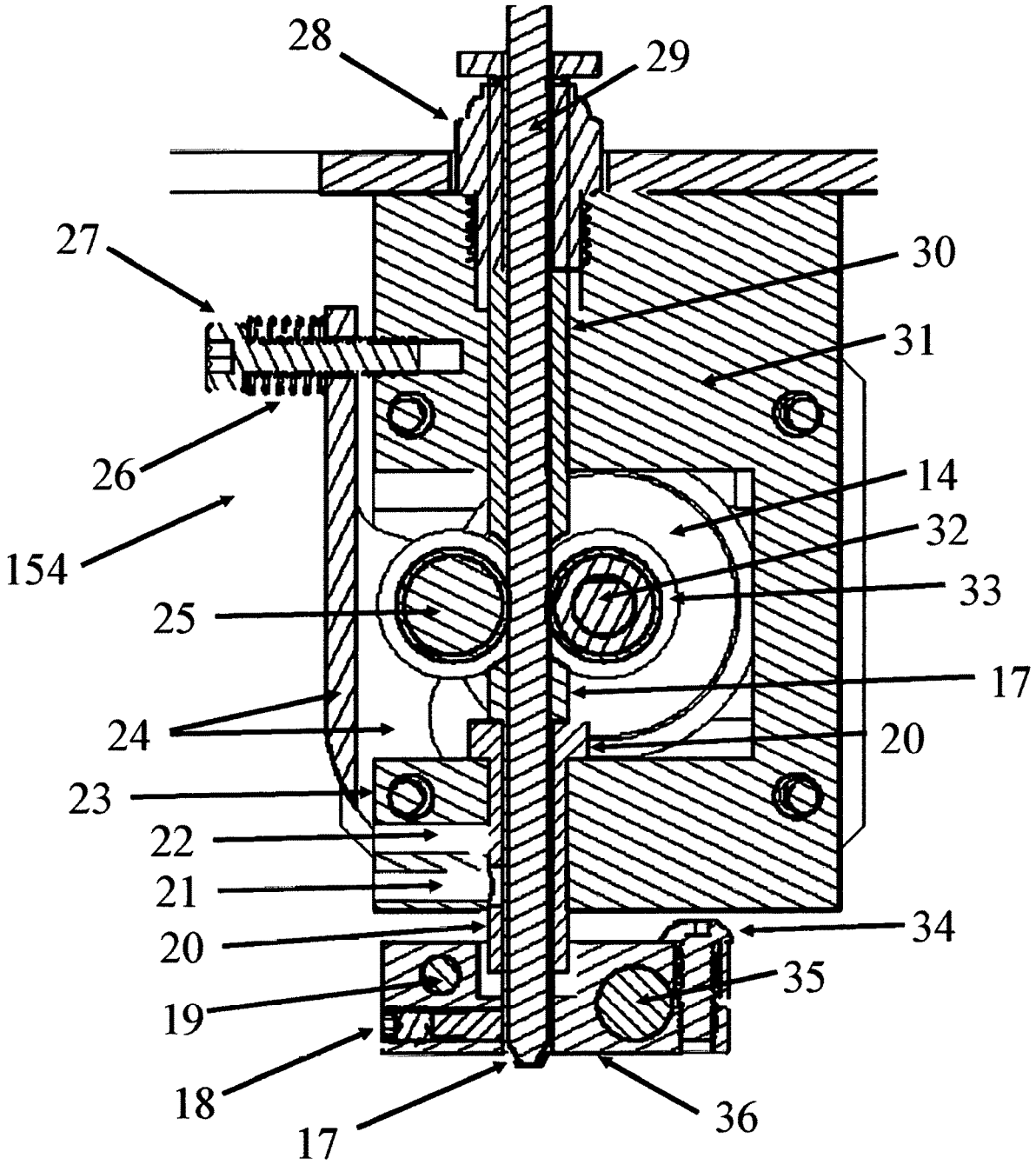
FIG. 4 illustrates a cross-section of a torque-and-pinch assembly of the multi-tool extrusion assembly, according to one embodiment.

FIG. 4 illustrates a cross-section of a first torque-and-pinch assembly 8 of the multi-tool extrusion assembly 150, according to one embodiment. The first torque-and-pinch assembly 8 may be used for barrier material extrusion. The barrier material in filament form (filament 29) enters the multi-tool extrusion assembly 150 through the inlet adapter 28. The filament 29 passes through a guide tube 30 and enters the first torque-and-pinch assembly 8. A motor 14 turns the motor shaft 32 which is attached to the filament gripping gear 33. A tension gear 25 applies counter pressure as the gears push the filament 29 downward. A compression spring 26 is used with an adjustment bolt 27, tensioner bracket 24 and pivot point 23 to apply the tension. The filament 29 is then pushed into a nozzle 17. The nozzle 17 may be a single piece nozzle. A heat spreader 20 transfers heat from the nozzle 17 to the heat sink (e.g., housing 31). The heat spreader 20 is secured by a first set screw 22, and the nozzle 17 is secured by a second set screw 21. A first portion of the filament 29 may be in the heat spreader 20 and a second portion of the filament 29 may be proximate the nozzle (e.g., in the barrier material hot-end assembly 7). The first portion of the filament 29 in the heat spreader 20 may remain solid and act as a ram to force the second portion of the filament 29 (e.g., softer filament) in the hot end (e.g., proximate the nozzle) out the nozzle 17. The barrier material hot-end assembly 7 includes a housing 36, a heater cartridge 35, and a temperature sensor 19. The heater cartridge 35 is clamped by a compression screw 34. The barrier material hot-end assembly 7 is attached to the nozzle 17 by a set screw 18.

Figure 5:
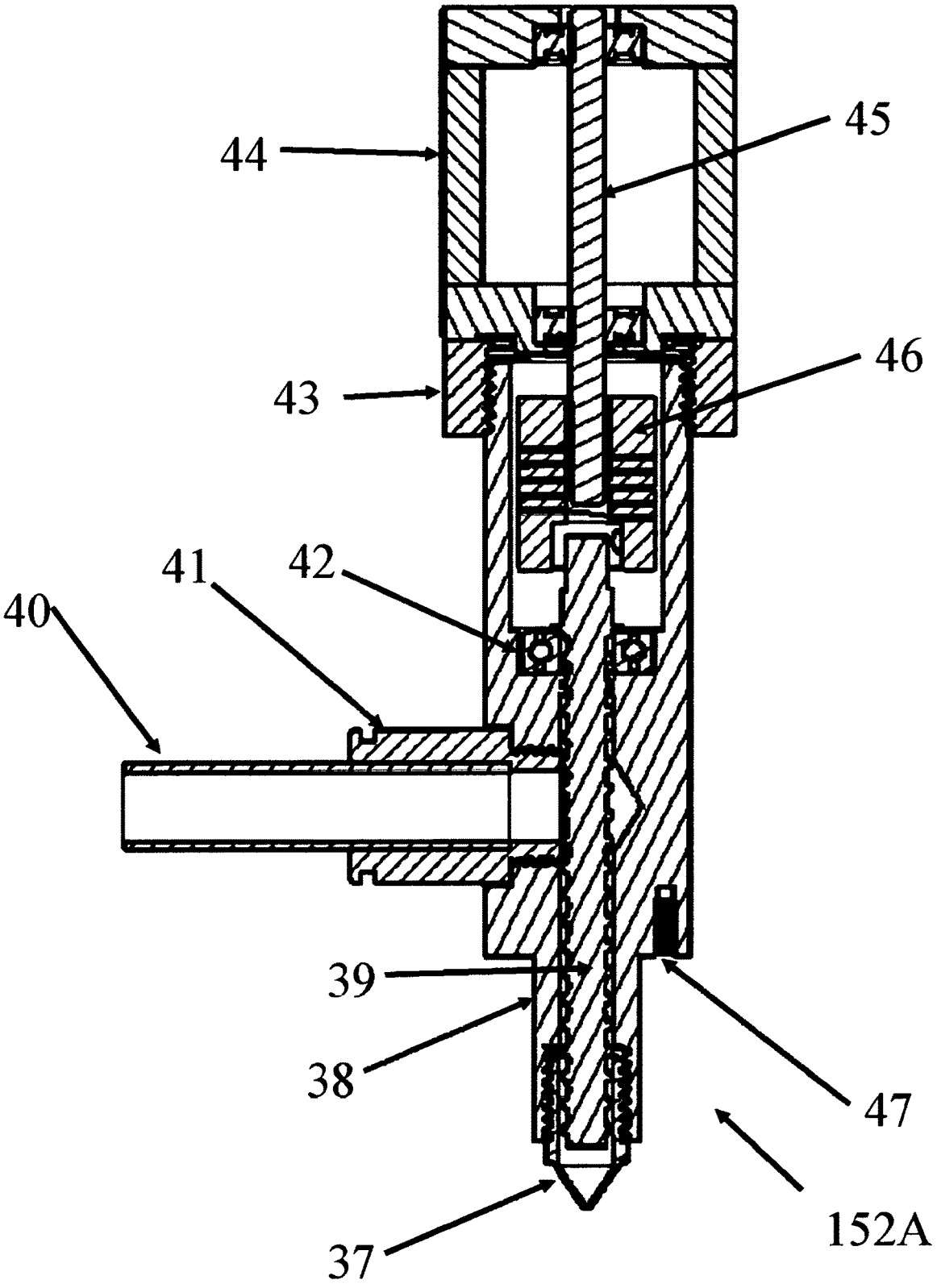
FIG. 5 illustrates a cross-section of an auger-screw extrusion system of the multi-tool extrusion assembly, according to one embodiment.

FIG. 5 illustrates a cross-section of an auger-screw extrusion system 152A of the multi-tool extrusion assembly 150, according to one embodiment. In some embodiments, the multi-tool extrusion assembly 150 may use the auger-screw extrusion system 152A (instead of a first torque-and-pinch assembly 8) to perform extrusion of the outer molding material in a semi-liquid state. The auger-screw extrusion system 152 may be a motor-driven auger screw conveyor. As the screw rotates, the barrier substance is forcefully and continually fed into a nozzle to provide the deposition of material onto the print surface.

Referring to FIG. 5, the semi-liquid barrier material (not shown for clarity) enters through a material inlet tube 40 which is attached to the main extruder housing 38 by an adapter 41. As the auger screw 39 feeds the semi-liquid barrier material, the semi-liquid barrier material exits through the nozzle 37 in a precise and controlled manner. A motor 44 turns the motor drive shaft 45 and is attached to the housing 47 by an adapter bracket 43. A motor coupler 46 transfers the motion from the drive shaft 45 to the auger screw 39. A ball-bearing 42 may ensure correct rotation of the auger screw 39. Mounting may be at specified locations in the housing 47.

Identification of a Filling Metal

The present disclosure, according to one embodiment, may maintain metal (metal filling) in liquid form throughout the duration of the build (of the additively manufactured part).

To maintain the object in the molten state, heat must be continuously transferred from the print surface to the object. Materials with high thermal conductivity may transfer heat more efficiently from the print surface to the main body of the metal. This maintains complex shapes in molten form farther away from the print surface. Conversely, if a material has low thermal conductivity the material may solidify before the part can be completed. Depositing metal over a solidified print may cause oxidation between layers and degradation of material properties.

An additional difficulty with printing metal has been the oxidation of the extruded material. At elevated temperatures, the outer layer of the metal undergoes oxidation with the atmosphere. This oxidation can prevent layers from adhering to one another and decreases the strength of the desired object. This may be mitigated by maintaining the manufactured object in the liquid state until the object is complete. Oxidized metal will migrate to the outer surface, leaving the inner metal intact.

A property of the metal is its viscosity (fluidity). If a metal flows more easily, it will adhere to the barrier material more readily and self-fill voids in the print; however, a more viscous material may have better extrusion control than a less viscous material, avoiding voids entirely. Proper extrusion timing and sequence may allow most liquid-metals to be used.

Another factor for material consideration is form and shape of the material prior to extrusion. Solid metal (often in the form of wire) is relatively easy to handle and produce. Powdered metal can be beneficial as it would not need to be melted prior to deposition above the print surface, but powdered metal is more difficult to handle and deliver to the extruder assembly.

Examples of preferable materials include metals and combinations of metals containing at least one of Aluminum, Tin, or Copper. Tin has a very low melting temperature (232 C) with a moderate thermal conductivity (67 W/m*K), which allows the material to be maintained in the molten state with relative ease. Aluminum has a higher melting temperature (660 C), but excellent thermal conductivity (205 W/m*K), which enables more intricate parts further from the print surface. Copper also has excellent thermal conductivity (401 W/m*K), but will melt at yet a higher temperature (1084 C). Any of these materials can work well as printable metals in the present disclosure.

Deposition or Extrusion of the Metal

One representation of metal deposition uses heated extrusion through a modified process similar to traditional 3D plastic extrusion. In this modified process, a motor operates a torque and pinch system (e.g., second torque-and-pinch assembly 11), which pulls a metal filament into a heating chamber, where the metal becomes molten and is extruded through a narrower nozzle. The solid filament outside the chamber acts as a pressure ram to force the molten metal through the printing nozzle, thus depositing the metal in the molten state. The traditional system has historical precedence as an effective method of extrusion in plastics which has been modified in the present disclosure for use with metal.

There are, however, several important distinctions worthy of note when compared to a plastic deposition system. Traditional 3D printing extrudes the plastic in a transition state, which maintains the general shape and adheres to the previous layers. When metal is extruded at elevated temperatures it will liquefy entirely, bypassing the transition state. This makes adhesion to previous layers difficult and maintaining form problematic, due to surface tension effects in the liquid. The present disclosure overcomes these complications by use of a barrier material. The surface tension of the metal increases adhesion to the barrier material which maintains the metal in the desired shape.

Figure 6:
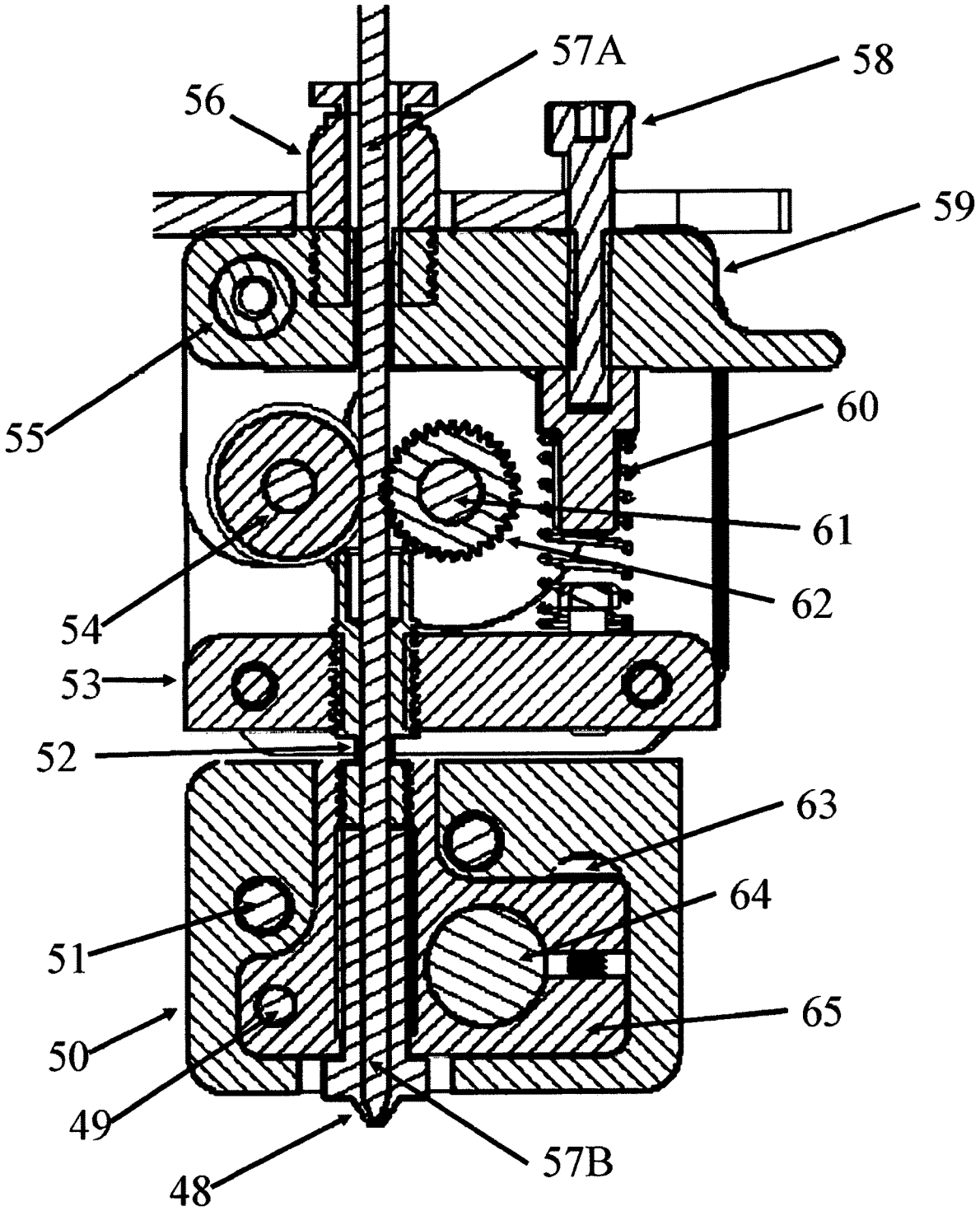
FIG. 6 illustrates a cross-section of a torque-and-pinch assembly of the multi-tool extrusion assembly, according to another embodiment.

FIG. 4 illustrates a cross-section of a second torque-and-pinch assembly 11 of the multi-tool extrusion assembly 150, according to one embodiment. The second torque-and-pinch assembly 11 may be used for metal deposition. As shown in FIG. 6, metal filament (filament 57) enters through an inlet adapter 56 and is pushed into the second torque-and-pinch assembly 11. The drive shaft 61 is attached to the filament gripping gear 62. A tensioned gear 54 applies counter pressure as the gears push the filament 57 downward. The tensioner system 154 includes a compression spring 60, an adjustment bolt 58, a tensioner bracket 59, and a pivot 55. The filament 57 is pushed into a heat-break 52 and then into the hot-end nozzle 48. The second torque-and-pinch assembly 11 may be mounted using the extruder housing 53.

The metal hot-end assembly 12 contains a housing 65, a temperature sensor 49, and a heater cartridge 64. The heater cartridge 64 is clamped by a compression screw 63. The hot-end assembly 12 is enclosed within a thermal insulator 50 which is attached by mounting screws 51. The filament 57A above the heat-break 52 is in solid form and acts as a ram to force the molten metal 57B through the hot-end nozzle 48 in a controlled manner.

Figure 7:
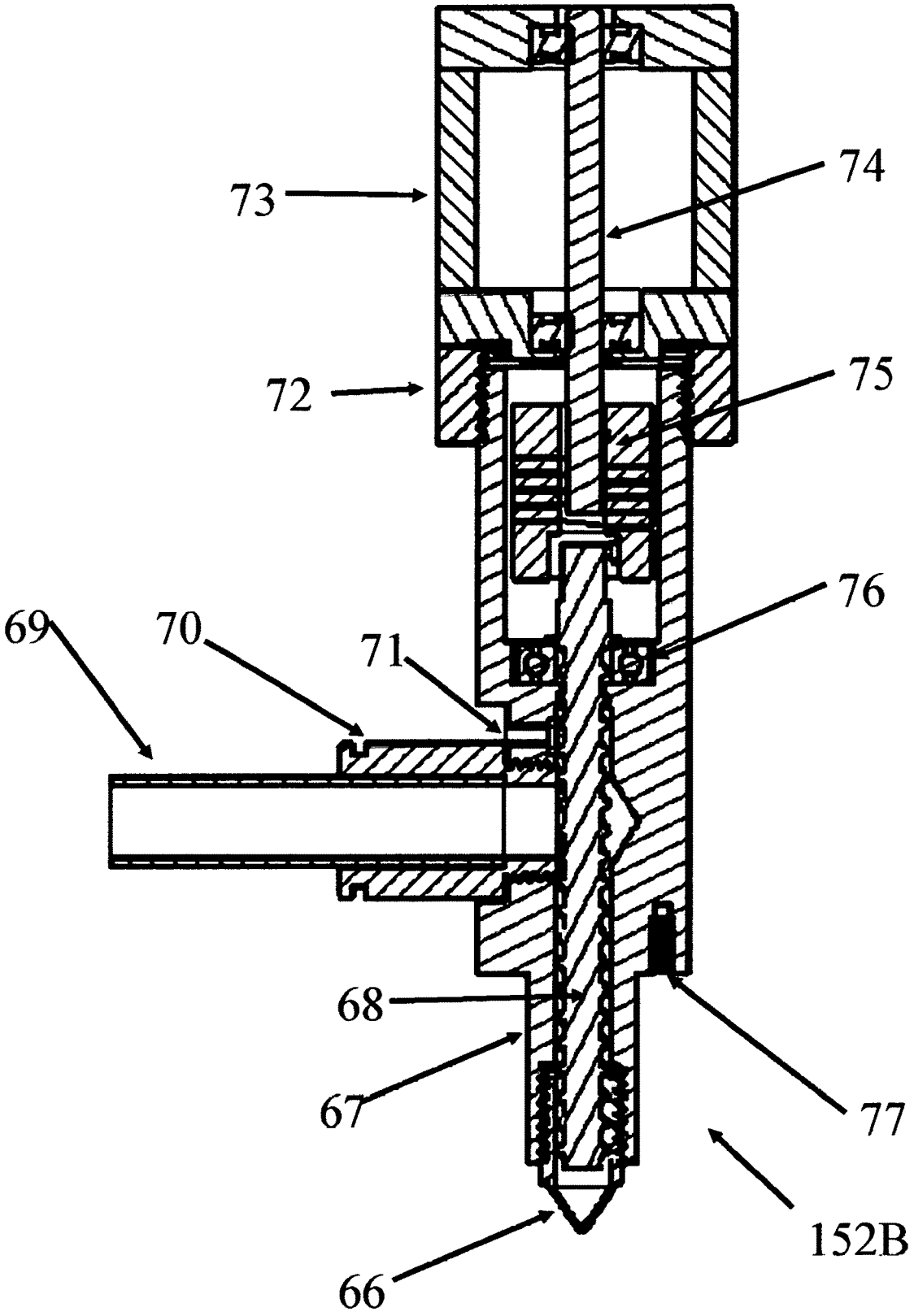
FIG. 7 illustrates a cross-section of an auger-screw extrusion system of the multi-tool extrusion assembly, according to another embodiment.

FIG. 7 illustrates a cross-section of an auger-screw extrusion system 152B of a multi-tool extrusion assembly 150, according to one embodiment. In some embodiments, the multi-tool extrusion assembly 150 may use the auger-screw extrusion system 152B (instead of a second torque-and-pinch assembly 11) to dispense powdered metal. The auger-screw extrusion system 152B may be an auger screw conveyor system, where the auger screw carries the powdered metal to the nozzle head in a continuous manner. The metal in this manifestation is distributed in the cold powdered state, and melted upon contact with the heated print surface or previously melted material. This type of system may be costlier and less accurate than other representations. The powder density can vary depending on particle size, and is substantially less dense than solid or liquid metal. When extruded, a greater volume of metal powder would need to be deposited, as it will shrink when it melts. Additional mechanisms needed to transport the powder may be costly and can often limit the print size. Powder transport systems include pneumatic, auger screws, and direct hopper configurations.

Referring to FIG. 7, the metal powder (not shown for clarity) enters as an airborne powder through a material inlet tube 69 which is attached to the main extruder housing 67 by an adapter 70. As the auger screw 68 feeds the metal powder, the metal powder exits through the nozzle 66 in a precise and controlled manner. A motor 73 turns the motor drive shaft 74 and is attached to the housing 77 by an adapter bracket 72. A motor coupler 75 transfers the motion from the drive shaft 74 to the auger screw 68. A ball-bearing 76 may provide correct rotation of the auger screw 68. Mounting is accomplished at specified locations in the housing 77.

A notable difference between the auger-screw extrusion system 152A of FIG. 4 (semi-liquid version) and the auger-screw extrusion system 152B of FIG. 7 (metal powder version) is the powder filter and export port 71. As metal powder in a gas stream enters the extruder, it travels up the auger screw 68 in a vortex to deposit the metal powder in the auger screw 68. As the gas stream exits, any metal powder that remains in the gas stream is filtered out next to the auger screw 68 and will be pushed downward when the auger screw 68 turns. This may provide a constant supply of powder to the auger screw 68.

Heated Print Surface

For applications in low-cost environments, a heated print surface may be used. The heated print surface may both cure the barrier material and transfer the heat to the print object that is needed to maintain the metal in the molten state. The printed material must have a sufficient thermal conductivity to transfer the heat from the print surface throughout the object.

Traditional 3D printers use a heated surface to prevent warping of the printed part and lifting of the part off the print surface. As plastic cools, it slightly shrinks, inducing a stress in the finished part. A heated print surface delays cooling until the part has sufficient strength to maintain the printed shape. Another method used to prevent these same issues is chamber heating where the entire print envelope is enclosed and heated. Traditional print surfaces only need to maintain a maximum temperature of about 110 C during the printing process, and use embedded resistance heaters to obtain the required temperatures at low cost. The material used in these heaters is typically incapable of withstanding the molten metal temperatures required for use in the present disclosure.

The present disclosure uses a heated print surface (e.g., build surface), but the purpose and intent may be substantially different from conventional heated print surfaces in plastic printers. The heated print surface of the present disclosure may operate at higher temperatures, between 200 and 1100 C, whereas most plastic printers operate between 50 and 110 C. The present disclosure does not experience problems with warping and lifting that plastic printers experience due to lower temperature of the heated print surface in plastic printers. In the present disclosure, the heated print surface may maintain the metal in the molten state and cure (burnout) the barrier material. Warping and lifting of the printed metal may only be a concern during cooling as the part solidifies.

To heat the print surface (e.g., build surface) to temperatures suitable for metal printing, various print bed heating techniques can be used. The present disclosure may use one or more of infrared heating, induction heating, or resistance heating.

The heating methods presented herein are commonly used in household applications. All three are used in stovetop burners and are viable in the industry. Additionally, infrared heaters are also used in space heaters and warmers. The commercial availability and success of these heating methods is a strong indication that when properly designed, any of the methods described herein can be adapted for use in the present disclosure.

In one embodiment, the heated print bed has a heated printing surface that includes one or more of nickel plated copper or graphite. The heated print bed may have a heated printing surface that is heated by one or more of an induction heater, a resistive heater, or an infrared radiation heater.

Figure 8:
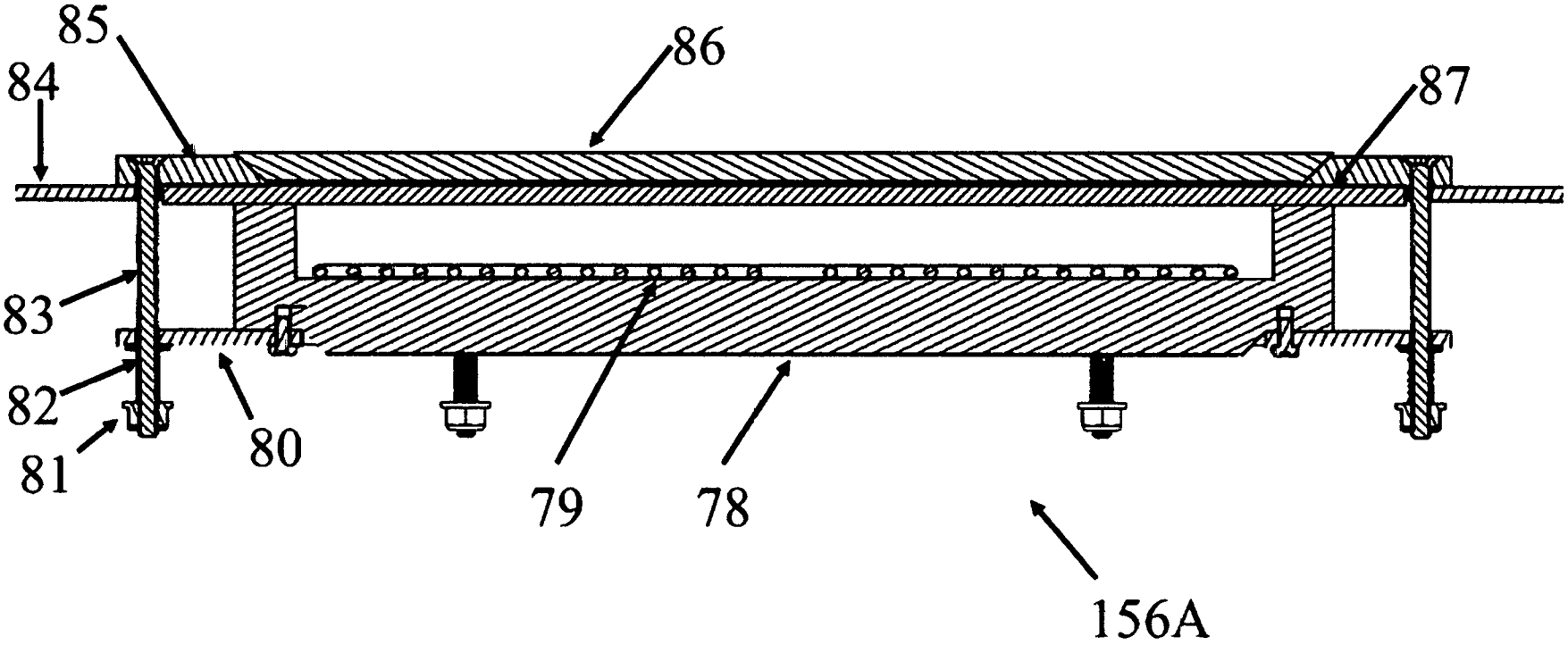
FIG. 8 illustrates a cross-section of a heated print bed assembly that is infrared-based, according to one embodiment.

FIG. 8 illustrates a heated print bed assembly 156A that is infrared-based, according to one embodiment. Infrared heating is accomplished by physically separating the heat source from the intended target. Once the source is substantially hot, the resulting radiation travels to the print surface causing it to heat up. A benefit of infrared heating is that the source and the target can be physically separated by materials transparent to radiation (such as glass). This separation allows the design to have greater thermal isolation of the print bed than other methods.

Referring to FIG. 8, a resistance-heated coil 79 is positioned away from the print surface 86. The coil is enclosed in a mounting body 78 which also acts as a thermal isolator. The infrared radiation generated from the resistance-heated coil 79 travels through a glass insulator 87 to the print surface 86. An adapter ring 80 mounts the insulation body by using a compression spring 82, mounting bolt 83, and adjustment nut 81. A print surface holder 85 acts as a mount for the print surface 86 without any bolted joints, allowing thermal expansion without any deformation to the print surface 86. The heated print bed assembly 156A uses a mounting plate 84 to attach to the printer (not shown).

Figure 9:
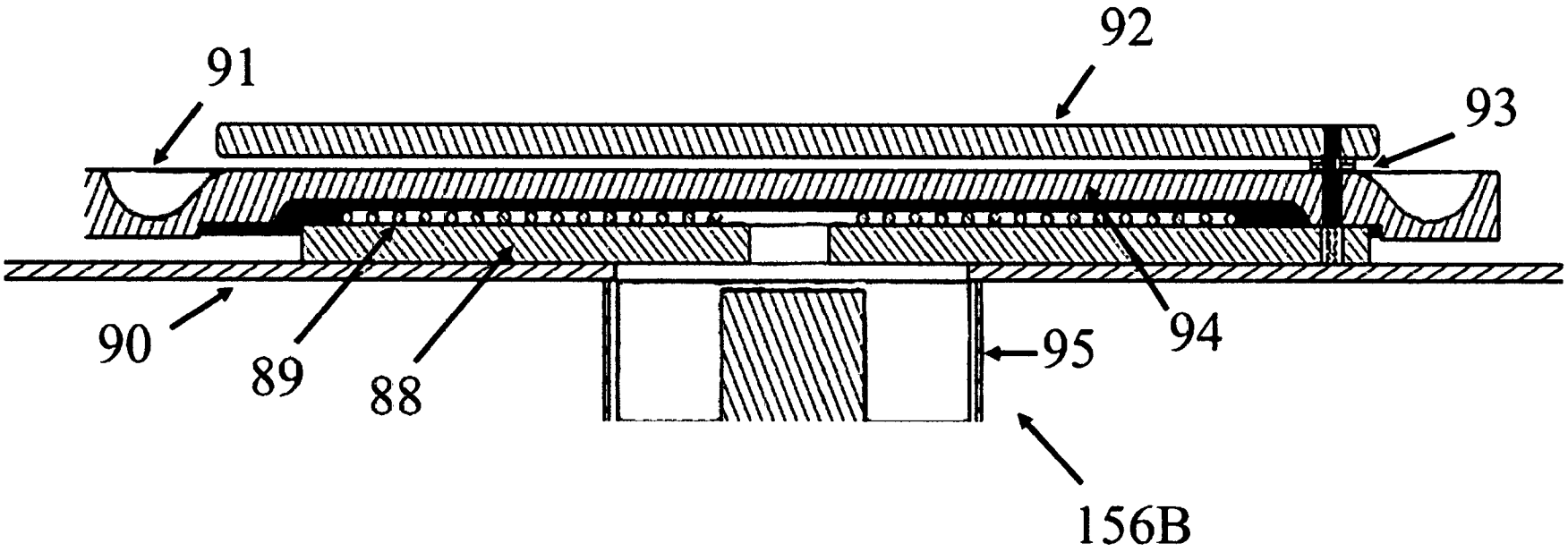
FIG. 9 illustrates a cross-section of a heated print bed assembly that is induction-based, according to one embodiment.

FIG. 9 illustrates a heated print bed assembly 156B that is induction-based, according to one embodiment. A useful option not common in additive manufacturing is the use of an induction heater to heat the heated print bed 1. Induction heating is accomplished by generating a large current in a conducting coil to create a magnetic field. A conductive object (print surface) within the field reacts to resist the field change, inducing a current within said object. The internal resistance to this current flow generates heat directly within the material. An induction heating circuit reverses the magnetic field at a given frequency to constantly heat the object.

Induction heating is used in both household appliances and metal foundries. The advantages of induction heating include 'non-contact' heating and high efficiency heat transfer using electricity. Conductors are susceptible to heating via induction, but magnetic materials are often the most efficient.

Induction heating also presents some difficulties to overcome. At temperatures over 400 C, the heating coils may be difficult to cool as there is limited space to provide convection cooling. This can lead to failure of the electrical insulation of the coil and short-circuit of the system. Another issue is that the print bed (and print object) typically have large electrical currents flowing through them, which must be accounted for in the electrical design and grounding scheme.

The induction heating embodiment presented herein may use a graphite print surface. Graphite's melting temperature is greater than that of almost all metals. Graphite is also highly resistive to a magnetic field (enabling induction heating), and has good thermal conductivity for an evenly heated bed.

Referring to FIG. 9, a graphite plate 92 is positioned next to an induction coil assembly 89. The induction coil assembly 89 is thermally insulated from the graphite plate 92 by standoff washers 93 and an insulation body 94. Behind (e.g., immediately behind) the induction coil assembly 89 is a magnetic flux core 88 which secures the induction coil assembly 89 and guides the magnetic field. The insulation body 94 also contains channels which act as a spill-shield 91 to protect the induction coil assembly 89 from failed builds. A mounted fan 95 air-cools the induction coil assembly 89. The induction coil assembly 89 is secured using a mounting plate 90.

Figure 10:
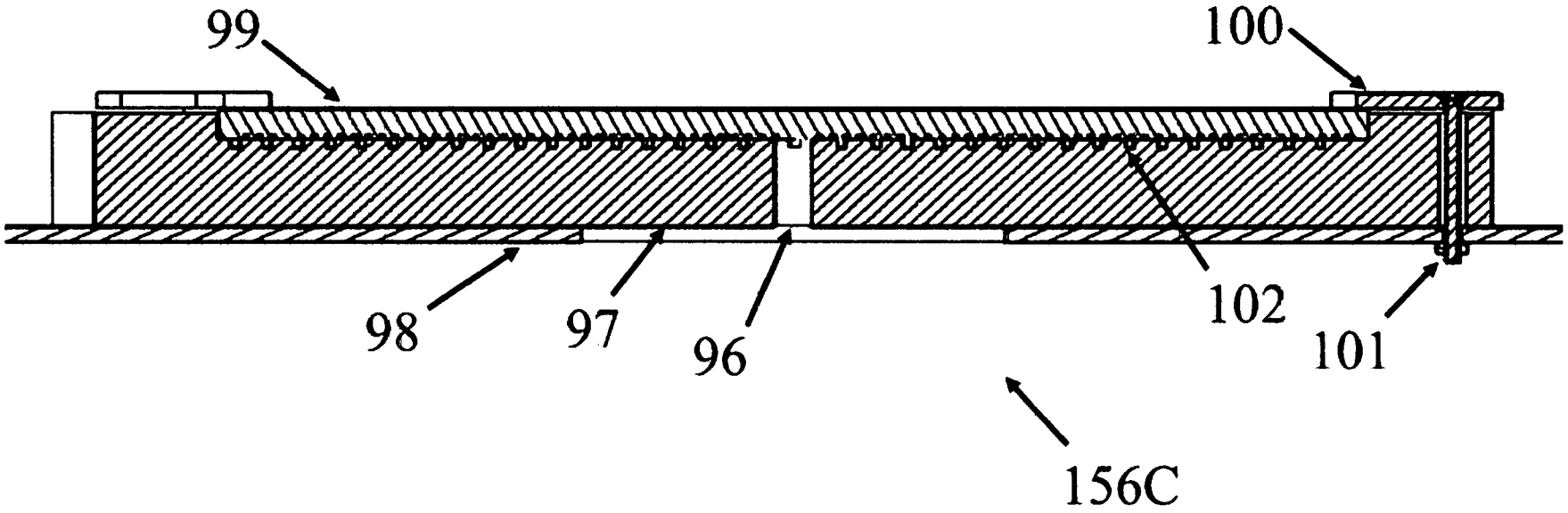
FIG. 10 illustrates a cross-section of a heated print bed assembly that is resistance-based, according to one embodiment.

FIG. 10 illustrates a heated print bed assembly 156C that is resistance-based, according to one embodiment. Heated bed assembly 156C may be driven by resistance heaters. Resistance heaters efficiently convert electrical energy into heat by driving current through a resistance wire. The wire can be directly bonded to the print surface or transfer heat to the print surface through conduction, convection, or radiation. This method is common for stove top burners, and when properly designed, can operate at temperatures required to melt metal.

Referring to FIG. 10, a heated print bed 99 is placed in semi-direct contact with the resistance heater wire 102. A small, electrically non-conductive gap is desired between the resistance heater wire 102 and the print surface 99 to prevent the resistance heater wire 102 from shorting to the print surface 99. The heater wire is held in place by an insulation body 97. The leads (not shown) for the electrical resistance heater wires 102 are passed through a center hole 96 and routed to the control electronics. The assembly is secured to the mounting plate 98 by a bolted joint 101. A clamp 100 holds the print surface 99 in place.

The choice of print bed material can be critical to the performance of the printer. A material with a low thermal conductivity may cause the printed part to solidify at a lower printed height and can increase strain on the heating elements. If the material oxidizes in the atmosphere, the bed may degrade over time. Additionally, the reflectivity of the bed should be considered. A highly reflective material (i.e. a polished metal) will minimize the heat lost to the environment, reducing the load on the heater. A highly emissive material (i.e. graphite) will lose more heat to the environment (print chamber) and could cause overheating of other printer components.

One of the challenges for a print bed is the ability to overcome thermal expansion issues due to large temperatures changes (about 400 C or greater). If the print surface is mounted in a traditional manner by using fasteners, the fasteners could cause the print surface to bow as the print surface heats up. If the print surface is made from a brittle material, such as graphite, this can also cause that material to crack. A design may allow the print surface to expand while still maintaining position.

Maintaining or Transitioning the Metal to the Molten State

The available heat flux into a printed body may limit the available print height of said body. To maintain the metal in the printed object in a liquid state, the heat flow into the object must equal or exceed that being dissipated through air convection and radiation. For any print, there exists a maximum size or shape for which the heated print surface is no longer able to transfer enough energy into the printed object to maintain the metal in the printed object in a liquid state.

Theoretically, the maximum heat transfer state should not be impacted by the extruder temperature or state (powder or molten). In practice, there is some coupling. Depositing the metal in powder form will require more energy from the heated print surface and could cause the transition of the entire liquid form into a solid. If metal is deposited in a molten state (at potentially a higher temperature than the liquid heated by the print surface), it can operate as another source of heating and allow a slightly larger print.

Another factor that can influence the print height and molten state of the metal is the barrier material. An insulative barrier material helps reduce the heat loss from the object, and may increase in thickness as needed to ensure adequate thermal insulation, thus producing a larger print. The reflectivity of this insulative barrier may also be important as radiation losses tend to dominate overall heat loss at higher temperatures. As mentioned previously, the barrier in one embodiment could be composed of a ceramic composite.

An alternate embodiment of a barrier material that can aid print height is a thermally conductive barrier that can transfer more heat to the object from the print surface than is lost to the surrounding environment. The downside of this method is an increased energy usage from the print surface. Examples of thermally conductive barrier materials include, but are not limited to ceramic alumina (which has high thermal conductivity) or a graphite-filled ceramic composite.

In another embodiment, transitioning metal to the molten state can be accomplished using a furnace or heated chamber. The outer retaining barrier material, the inner metal filling, and the build surface may be placed in a heated chamber to transition the inner metal filling to the molten state. If the object is of sufficient height or geometry to prevent the print from being maintained in liquid form during the print, it is possible to reverse the effects of oxidation and layer adhesion after the part has been completed.

After deposition completion and with the barrier still attached to the build platform, the barrier, print surface, and inner metal filling could be removed from the printer and placed in a furnace. The metal may then transition back to the molten state and any oxidized material may migrate to the surface. The metal object may continue to conform to the barrier while this occurs. When the part cools and solidifies, the barrier can be removed to produce the final part.

Sequence of Deposition

The present disclosure describes a sequential deposition of barrier material and metal. In any variation of the process, the metal may be kept in the liquid state and contained by the barrier material. This process overcomes many of the issues that previously prevented additive manufacturing of these metals—surface tension and oxidation.

To join metals properly for additive manufacturing, each layer must adhere to the previous layer with the full strength of the material being printed. In metals, this is typically accomplished through thermal state changes (e.g., melting and re-solidifying to correctly form the layer). Some common materials, such as copper and aluminum, oxidize in the atmosphere at melting temperatures, forming an oxide layer over the surface of the metal. When printing, this layer may prevent future layers from adhering, eliminating much of the strength of the desired object.

The present disclosure mitigates this issue by maintaining the manufactured object in the liquid state until it is complete. Any oxidized material will be confined to the outer surface, leaving the inner metal intact.

Another issue that has prevented additive manufacturing of metals has been surface tension effects. Traditional additive manufacturing of plastics occurs in a transition state where the material is between a liquid and solid. The transition state allows the material to adhere to previous layers enough to form a bond, but also maintains the required shape to form the object. With metals, there is no useful transition state, requiring that the metal be liquid when deposited. In liquid form, the surface tension causes the material to bead up, losing dimensions that were desired when extruded.

The present disclosure embraces the surface tension effects of liquid metal by using it to form the desired shape. When the liquid metal contacts the barrier material, the surface tension will pull the metal toward the barrier much like water will adhere to solids. This tension force may maintain the object in the desired form for the duration of the print.

The deposition of both the barrier material and the metal filling as described herein, may occur in a sequential manner. One representation of the sequential extrusion takes place in a layer-by-layer fashion, where one layer of the retaining barrier is extruded in the desired form, and is then subsequently filled by depositing the inner, molten metal layer. The alternation between the two layers builds three-dimensionally, with each layer of molding material and metal filling adding to the preceding layer until the final product is achieved.

Figure 11:
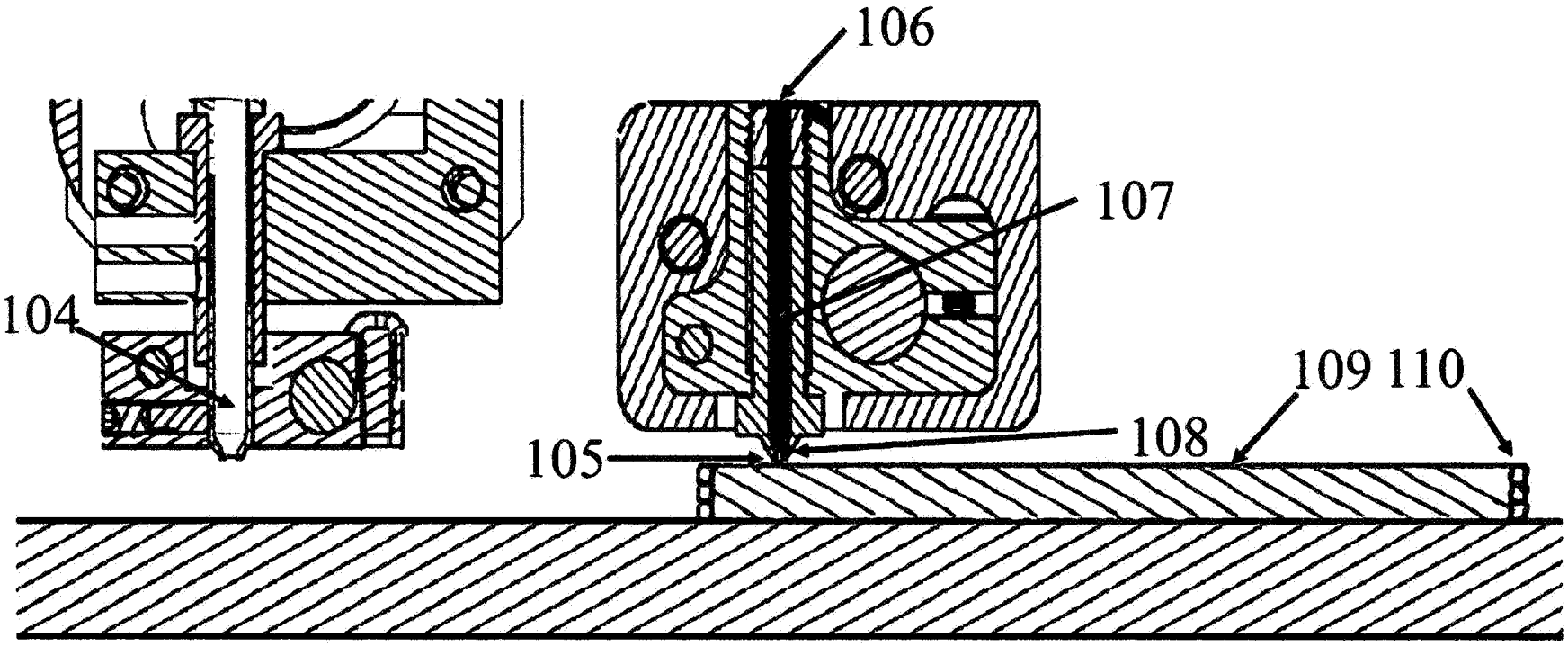
FIG. 11 illustrates a cross-section of the multi-tool extrusion assembly performing a metal manufacturing process in a sequential layer-by-layer method, according to one embodiment.

FIG. 11 illustrates a cross-section of the multi-tool extrusion assembly 150 performing a metal manufacturing process in a sequential layer-by-layer method, according to one embodiment. A barrier material 104 is extruded to form the containing barrier 110 for the print. Liquid metal 107 is extruded through the print nozzle 108. The interface 105 between the newly deposited metal and previously deposited metal 109 forms a fluid connection due to surface tension. For reference, the solid-to-liquid transition 106 of the metal occurs at the inlet to the hot-end body. In this FIG. 11, three previous layers may have been previously completed.

An alternative embodiment of this process deposits the layers of barrier material one upon another to complete the programed vessel, after which the molten metal fills the hollow form. In this method, the metal deposition interface between the nozzle and the molten metal forms a stream.

Figure 12:
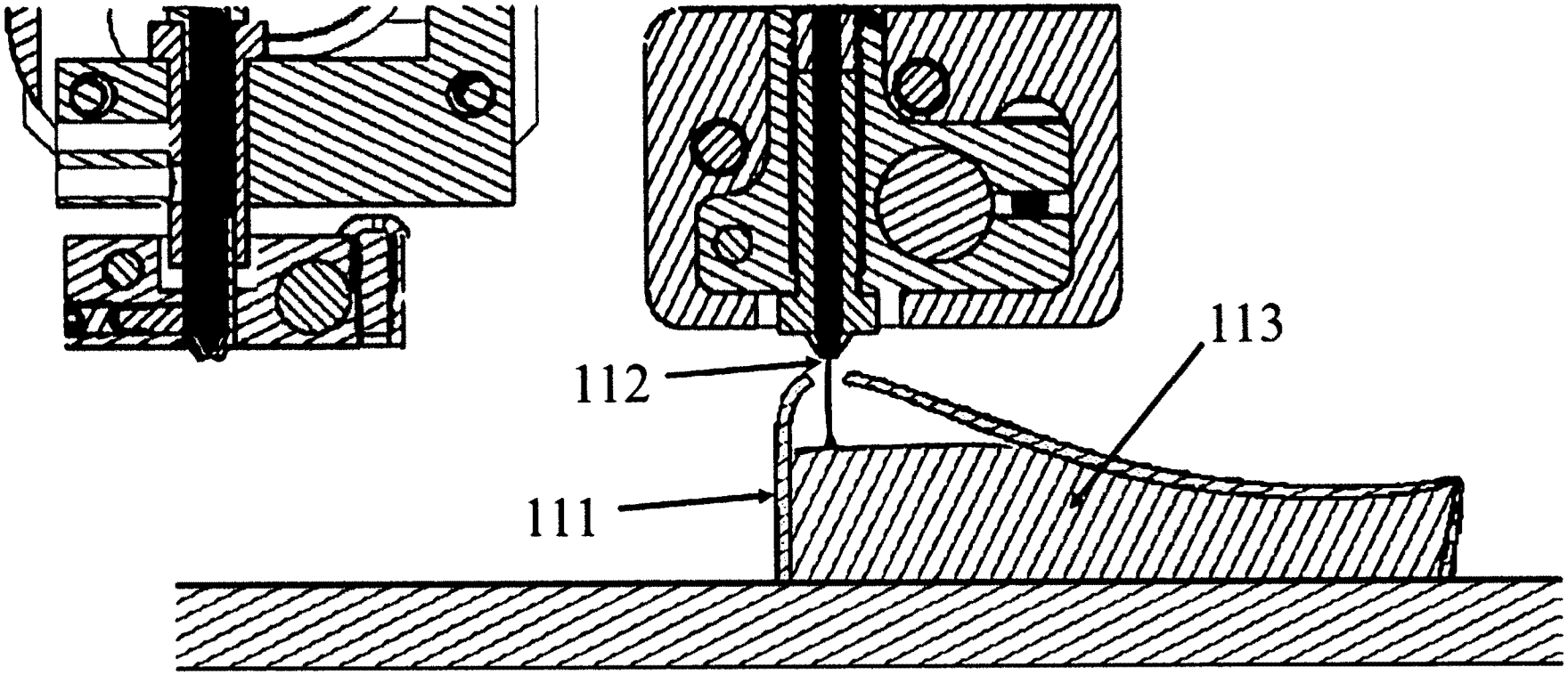
FIG. 12 illustrates a cross-section of the multi-tool extrusion assembly performing a metal manufacturing process in a barrier-first layer-by-layer method, according to one embodiment.

FIG. 12 illustrates a cross-section of the multi-tool extrusion assembly 150 performing the metal manufacturing process in a barrier-first layer-by-layer method, according to one embodiment. The retaining barrier 111 has been fully completed prior to deposition of the metal. A continuous stream of liquid metal 112 is deposited into the barrier where it forms the liquid metal body 113.

The previous two embodiments of deposition methods have corresponding embodiments using powdered metal. A difference in these embodiments is the metal interface to the liquid metal body. Newly deposited powder may sit briefly on the surface of the liquid due to surface tension effects. Once the powder melts and is absorbed, it increases the height of the molten metal in the retaining barrier.

Figure 13:
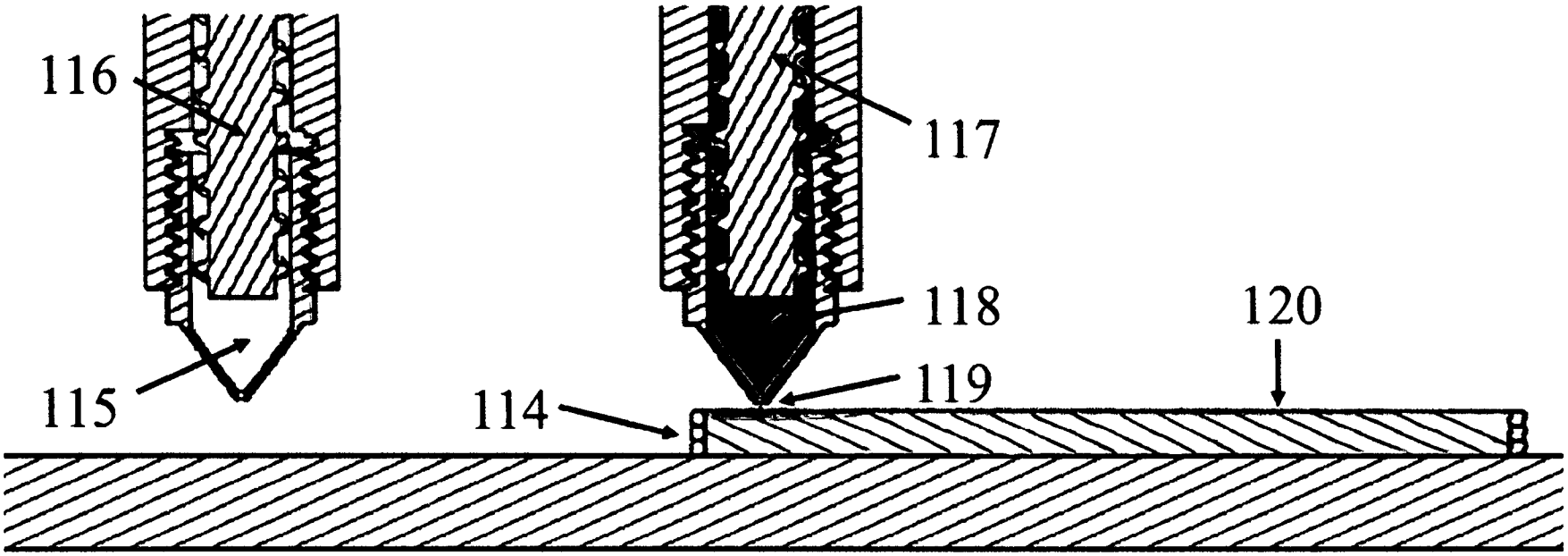
FIG. 13 illustrates a cross-section of the multi-tool extrusion assembly performing a metal manufacturing process using powdered metal in a sequential layer-by-layer method, according to one embodiment.

FIG. 13 illustrates a cross-section of the multi-tool extrusion assembly 150 performing a metal manufacturing process using powdered metal in a sequential layer-by-layer method, according to another embodiment. Layer-by-layer deposition uses alternate extruders driven by auger screws. A metal extruder 117 pushes the powdered metal 118 though the nozzle where it is deposited over the liquid metal body 120, forming the powdered metal interface 119. Another extruder 116 pushes the barrier material 115 through a nozzle to form the retaining barrier 114. In this FIG. 13, three previous layers may have been previously completed.

Figure 14:
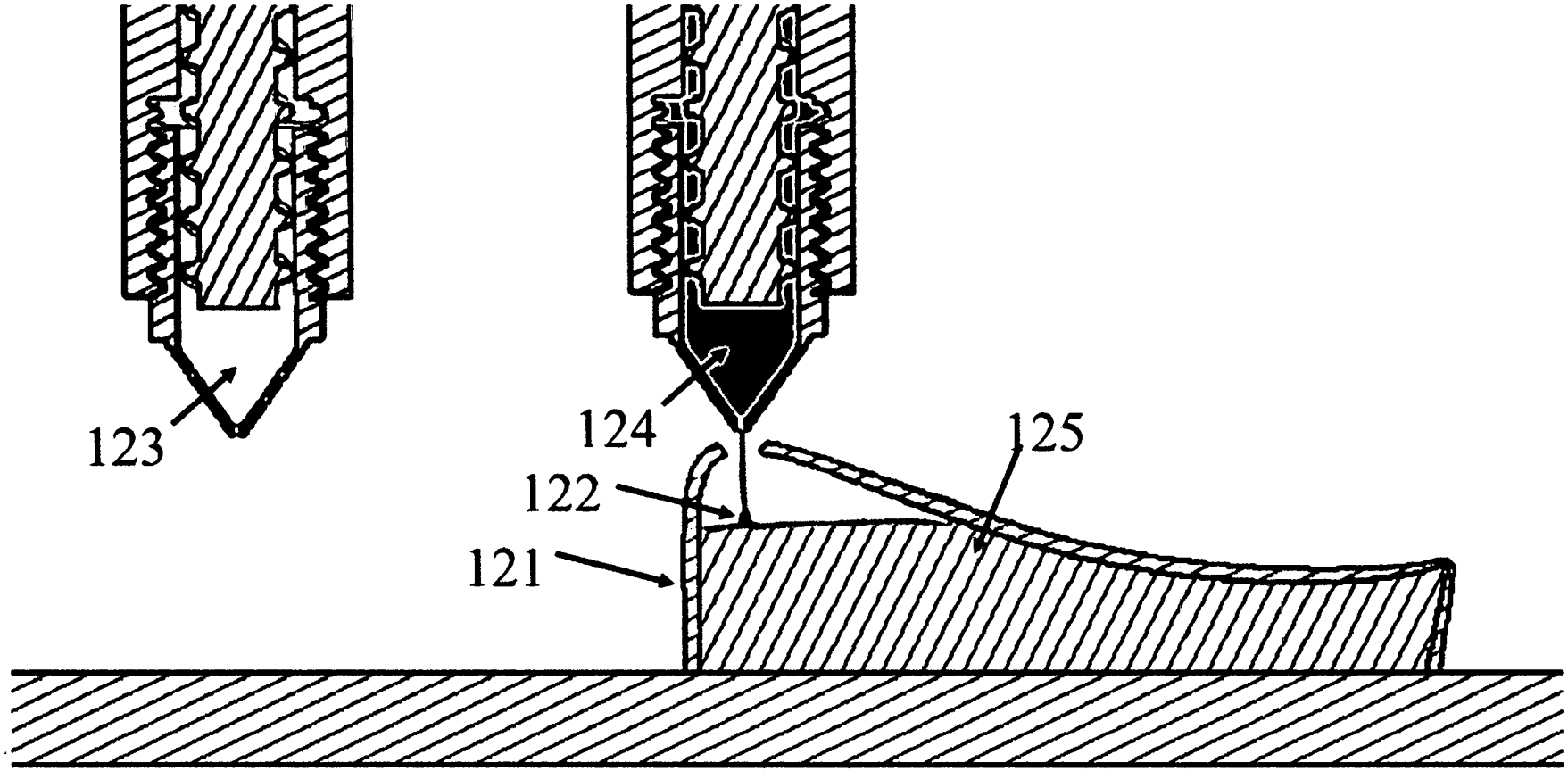
FIG. 14 illustrates a cross-section of the multi-tool extrusion assembly performing a metal manufacturing process using powdered metal in a barrier-first layer-by-layer method, according to another embodiment.

FIG. 14 illustrates a cross-section of the multi-tool extrusion assembly 150 performing a metal manufacturing process using powdered metal in a barrier-first layer-by-layer method, according to another embodiment. The barrier material 123 is fully deposited to form the retaining barrier 121. Metal powder 124 is deposited over the previously melted metal 125 to form the powdered metal interface 122. FIG. 14 may illustrate the metal filling being nearly completed.

In any sequence of deposition and filling, the barrier material should be deposited prior to the metal filling to maintain the required shape. Specific barrier materials and metal forms are included as examples, and are not meant to limit the possible embodiments of the present disclosure.

Cooling

Once the print is complete, heat transfer from the object is to be controlled. The transition time of the object from liquid to solid can vary depending on the desired end-product state. If the print has small features, these may solidify first, potentially causing distortion in the final print. Conversely, if a part is mostly solid, it may be desirable to increase the cooling rate to decrease production time. High thermal conductivity in the print surface (such as graphite or copper) will allow the print surface to act as a heat sink (cooling agent) and cool the object more rapidly.

There are many variations of cooling routines that can be used to produce specific cooling patterns. Fans directing air to the printed object can cause the barrier material to cool first and begin the cooling from the outer-layers of the object. Using the heating element, the print may also undergo annealing (high temperature stress reduction) while on the print surface to help reduce distortions from cooling. Another cooling method is bottom-up solidification where a fan cools the print surface directly.

Once the part is solidified and cooled, it is removed from the print surface. The barrier material is then cracked off, and the final part results. Chemical solutions can remove the oxidation from the outer surfaces, and cleaning methods such as ultrasonic cleaning can remove any traces left from the barrier material. If specific heat treatments or surface coatings are required, these can be added using any traditional process.

An embodiment of the present disclosure may be as follows: 1) A ceramic-polymer barrier material is extruded by 2) a torque-and-pinch system. 3) The printed metal is in filament (wire) form, 4) and is extruded by a modified torque-and-pinch system. 5) An infrared heater heats the print surface. 6) The print surface is plated copper. 7) The printed object is accomplished by a layer-by-layer method where a single layer of barrier material is added, followed by a single layer of metal. 8) The print is cooled directly by fans and by using the print surface as a heat-sink.

1) The ceramic-polymer barrier material is contained in a filament form. This allows the printer to be started at any moment, whereas some of the other barrier materials require significant preparation prior to printing. The ceramic-polymer hardens after being deposited, and once the polymer is burnt out of the barrier material, it is capable of withstanding temperatures of several thousand degrees Celsius. The ceramic is brittle, but also maintains dimensional stability during the print.

2) A modified torque-and-pinch system is used to extrude the barrier material to provide consistent extrusion and reduce preparation time to create a print. This method can retract the filament out of the hot zone to prevent thermal degradation of the filament prior to extrusion.

3) Each of the metals used has the correct combination of thermal conductivity and melting temperature to produce a reliable part. The metal is in wire form, which is compact, easily obtainable, and can be easily delivered to the extruder.

4) A modified torque-and-pinch system is used to extrude the metal. This process is reliable and can be easily adapted to common additive manufacturing extrusion methods. This method also extrudes the material in a liquified state, reducing the heat load on the print surface.

5) An infrared heater is used to heat the print surface due to the thermal management benefits. As the source of heat is separated from the print surface by several inches, thermal isolation, cooling, and power management can all be performed more easily than other methods presented herein.

6) The print surface is plated copper. Copper has an excellent thermal conductivity, but suffers from oxidation at elevated temperatures. To prevent detrimental oxidation, the copper is nickel plated. When exposed to elevated temperatures nickel will form a stable oxide, which will then protect the base copper.

7) The sequence of deposition in layer-by-layer form allows a more generalized shape to the extrusion. This allows a molten material to more easily fill crevasses where it might otherwise produce voids as air pockets accumulate. The barrier material is allowed more time to fully cure between each layer than in a single fill-method as well. Surface tension and oxidation are managed with all methods described previously.

8) Cooling the print simultaneously by use of fans and the print surface may accomplish a time-efficient print and promote a uniform cooling of small features and the base material. This method is highly print-dependent, but can be used where appropriate. Once cooling is complete, the parts are deposited into a chemical bath to remove the oxide layers and ultrasonically cleaned to remove any remnants of the barrier material.

The above description of illustrated implementations of the disclosure, including what is described in the Abstract, is not intended to be exhaustive or to limit the disclosure to the precise forms disclosed. While specific implementations of, and examples for, the disclosure are described herein for illustrative purposes, various equivalent modifications are possible within the scope of the disclosure, as those skilled in the relevant art will recognize.

Various operations are described as multiple discrete operations, in turn, in a manner that is most helpful in understanding the present disclosure, however, the order of description should not be construed to imply that these operations are necessarily order dependent. In particular, these operations need not be performed in the order of presentation.

The terms "over," "above" "under," "between," and "on" as used herein refer to a relative position of one material layer or component with respect to other layers or components. For example, one layer disposed above or over or under another layer may be directly in contact with the other layer or may have one or more intervening layers. Moreover, one layer disposed between two layers may be directly in contact with the two layers or may have one or more intervening layers. In contrast, a first layer "on" a second layer is in direct contact with that second layer. Similarly, unless explicitly stated otherwise, one feature disposed between two features may be in direct contact with the adjacent features or may have one or more intervening layers.

What is claimed is:

1. A method of creating an additively manufactured part, the method comprising:

depositing at least one layer of an outer retaining barrier on a build surface;

depositing at least one layer of an inner metal filling on the build surface within the at least one layer of the outer retaining barrier, wherein the at least one layer of the inner metal filling is deposited as a powder or solid material;

wherein the depositing of the at least one layer of the outer retaining barrier and the depositing of the at least one layer of the inner metal filling on the build surface comprises depositing a single layer of the outer retaining barrier; and subsequent to the depositing of the single layer of the outer retaining barrier, depositing a single layer of the inner metal filling; and repeating each single layer combination of outer retaining barrier and inner metal filling;

heating, by the build surface, the inner metal filling to a molten state for filling on the build surface whereby the inner metal filling in the molten state fills a form for the additively manufactured part defined by the outer retaining barrier and wherein the inner metal filling is maintained in a liquified condition by the build surface; and removing the outer retaining barrier after the additively manufactured part is formed.

2. The method of claim 1 further comprising placing the outer retaining barrier material, the inner metal filling, and the build surface in a heated chamber to transition the inner metal filling to the molten state.

3. The method of claim 1 further comprising heating the build surface and heating the inner metal filling to the molten state by direct contact between the inner metal filling and the heated build surface.

4. The method of claim 1 further comprising heating the build surface and heating the inner metal filling to the molten state by the inner metal filling being proximate the build surface.

* * * * *